US008784403B2

(12) United States Patent
Cefai et al.

(10) Patent No.: US 8,784,403 B2
(45) Date of Patent: Jul. 22, 2014

(54) WAX MICRO ACTUATOR

(75) Inventors: Joseph John Cefai, Swansea (GB); Julian Llewellyn Shapley, Cardiff (GB)

(73) Assignee: Cellnovo, Ltd., Swansea (GB)

( * ) Notice: Subject to any disclaimer, the term of this patent is extended or adjusted under 35 U.S.C. 154(b) by 729 days.

(21) Appl. No.: 12/447,225

(22) PCT Filed: Oct. 25, 2007

(86) PCT No.: PCT/GB2007/004073
§ 371 (c)(1),
(2), (4) Date: Jan. 4, 2010

(87) PCT Pub. No.: WO2008/050128
PCT Pub. Date: May 2, 2008

(65) Prior Publication Data

US 2010/0145272 A1 Jun. 10, 2010

(30) Foreign Application Priority Data

Oct. 26, 2006 (GB) ..... 0621344.1

(51) Int. Cl.
*A61M 5/00* (2006.01)

(52) U.S. Cl.
USPC ..... 604/890.1

(58) Field of Classification Search
USPC ..... 604/890.1, 891.1, 65, 66, 67, 131–133; 251/213, 11; 417/413.1–413.3
See application file for complete search history.

(56) References Cited

U.S. PATENT DOCUMENTS

| | | | | |
|---|---|---|---|---|
| 3,176,712 | A | 4/1965 | Clement | |
| 3,297,260 | A | 1/1967 | Barlow | |
| 4,152,098 | A * | 5/1979 | Moody et al. | 417/413.1 |
| 4,210,173 | A | 7/1980 | Choksi et al. | |
| 4,858,619 | A | 8/1989 | Toth | |
| 5,020,325 | A | 6/1991 | Henault | |
| 5,388,615 | A | 2/1995 | Edlund et al. | |
| 5,520,661 | A | 5/1996 | Lal et al. | |
| 6,749,407 | B2 | 6/2004 | Xie et al. | |
| 2002/0037221 | A1 | 3/2002 | Mastrangelo et al. | |
| 2004/0094733 | A1 * | 5/2004 | Hower et al. | 251/11 |

FOREIGN PATENT DOCUMENTS

| | | |
|---|---|---|
| CN | 1375338 | 10/2002 |
| CN | 1375338 A | 10/2002 |
| DE | 19723648 | 8/1998 |
| EP | 1403519 | 3/2004 |

(Continued)

OTHER PUBLICATIONS

PCT International Search Report, European Patent Office, PCT/GB2007/004073, Jan. 31, 2008.

*Primary Examiner* — Aarti B Berdichevsky
(74) *Attorney, Agent, or Firm* — Roy P. Issac, Esq.; Carolyn S. Elmore, Esq.; Elmore Patent Law Group, P.C.

(57) ABSTRACT

An actuator comprises a cavity containing a working medium that reversibly expands as it undergoes a phase change from a solid to a liquid state, a diaphragm disposed adjacent the cavity such that expansion and contraction of the expandable working medium causes the diaphragm to deflect, and a semiconductor element disposed in the cavity, wherein the semiconductor element is adapted to heat the working medium to cause it to undergo the phase change into the liquid state. The actuator may be used in a pump for an infusion system.

28 Claims, 6 Drawing Sheets

(56) References Cited

FOREIGN PATENT DOCUMENTS

| | | | |
|---|---|---|---|
| EP | 1403519 | A1 | 3/2004 |
| FR | 2507637 | | 12/1982 |
| FR | 2731475 | | 9/1996 |
| FR | 2731475 | A1 | 9/1996 |
| GB | 875034 | | 8/1961 |
| GB | 1204836 | | 9/1970 |
| GB | 1204836 | A | 9/1970 |
| GB | 1395420 | | 5/1975 |
| GB | 2008806 | | 6/1979 |
| GB | 2008806 | A | 6/1979 |
| GB | 2077367 | | 7/1979 |
| GB | 2077367 | A | 12/1981 |
| GB | 2456681 | | 7/2009 |
| JP | 06098988 | | 4/1994 |
| JP | 6098988 | A | 4/1994 |
| JP | 2004247271 | | 9/2004 |
| JP | 2004247271 | A | 9/2004 |
| JP | 2004274719 | A | 9/2004 |
| JP | 2005188355 | A | 7/2005 |
| JP | 2006159228 | A | 6/2006 |
| JP | 2006249130 | A | 9/2006 |
| WO | 02/068823 | | 9/2002 |

* cited by examiner

WAX MICRO ACTUATOR

CROSS REFERENCE TO RELATED APPLICATION

The present application is the U.S. national stage application of International Application PCT/GB2007/004073, filed Oct. 25, 2007, which international application was published on May 2, 2008 as International Publication WO 2008/050128. The International Application claims priority of British Patent Application 0621344.1, filed Oct. 26, 2006.

FIELD OF THE INVENTION

In devices for the programmed delivery of therapeutic products into the human or animal body, there is generally provided a pressurised reservoir of therapeutic product working in cooperation with a pumping chamber and valve means. The therapeutic product is typically pumped by the device through a tube to a cannula that pierces the patient's skin. The device can be capable of providing a variable rate of infusion of the therapeutic product to the patient over several days. This invention is directed to an improved wax-type micro-actuator for the pumping chamber.

BACKGROUND TO THE INVENTION

Therapeutic products can be administered to a human or animal in a variety of ways and the administration method is often matched to the specific requirements of the therapeutic product and its intended action. While oral administration is typically preferred, some therapeutic products, such as insulin, have to be administered in such a way as to avoid the digestive system, or it may be beneficial to deliver them directly to the site of intended action.

The administration of therapeutic products to avoid the digestive tract is known as parenteral delivery and is typically achieved by administering the therapeutic product as a liquid formulation directly into the circulation. This is commonly performed using a syringe or equivalent device to deliver a bolus of therapeutic product, or an infusion system capable of continuous, and in some cases programmed, delivery of therapeutic product. It is clear that the controlled administration of the therapeutic product more adequately matches the clinical requirements of these products, often offering better therapeutic control and reducing toxicity.

There is a growing demand for intensive insulin therapies for controlling glucose in people with diabetes. These therapies require that the patient administer regular insulin in an attempt to mimic the daily pattern of insulin release in an individual without diabetes. The pattern of insulin release in people without diabetes is complex. Generally, there is a background level of insulin that acts to control a fasting glucose and this is supplemented by temporary increases that counteract glucose released from ingested meals.

To meet this demand a number of infusion systems have appeared based on positive pressure reservoirs working in cooperation with a pulsatile pumping chamber having one-way check-valves operating at the inlet and/or the outlet of the pumping chamber.

An exemplary prior art infusion system is described in U.S. Pat. No. 4,714,462. This document describes an infusion system where therapeutic product is held in a reservoir at a positive pressure just below the infusion pressure required to introduce the therapeutic product into an animal or human. Therapeutic product is withdrawn from the reservoir via a one-way check-valve into a chamber by drawing a bellows member under the action of a solenoid thus increasing the volume of the chamber. Upon release of the solenoid the bellows member under the action of a return spring forces the therapeutic product via an outlet fluid restrictor to an infusion site. The outlet restrictor functions as part of an infusion rate sensor. The system can be programmed by a user to provide both basal and bolus dosages of therapeutic product, such as insulin.

Many infusion systems are dedicated for use in managed care environments, such as hospitals and medical care facilities due to their complexity, and the restrictions they place on the patient's freedom of movement. In such large systems, a variety of mechanisms may be employed to drive the pumping chamber. Typically, an actuator is connected to the pumping chamber such that movement of the actuator displaces a member or diaphragm of the pumping chamber to pump the liquid therapeutic product.

The actuator described in U.S. Pat. No. 4,714,462 is a solenoid actuator comprising an armature which is a component part of a solenoid. The armature is biassed via a spring in a direction to reduce the volume of the pumping chamber. The solenoid is driven by an electronics module. When the solenoid is energised the armature is driven in a direction such that the volume of the pumping chamber is increased, which draws fluid from the positive pressure reservoir until the pumping chamber is full. The solenoid is subsequently de-energised and the actuator spring provides a bias force on the armature that drives to decrease the volume of the pumping chamber thus pumping fluid toward the infusion site.

Other known actuators use piezo-electric effects to drive the actuator. However, the solenoid and piezo-electric actuators have a problem in that, as they are reduced in size for use in micro-fluidic systems, the driving force achievable by these actuators becomes substantially reduced.

An example of a micro-pump is described in U.S. Pat. No. 4,152,098. The pump has a flexible, resilient diaphragm which operates as a moveable resilient wall of a pumping chamber, under electro-magnetic actuation of a plunger, to cause the pumping action. The pump comprises an armature or plunger made of magnetic steel slidably moveable in an anti-friction sleeve. An electro-magnetic coil arrangement surrounds the sleeve and the plunger is moveable up and down with respect to the sleeve on energising the coil arrangement. Whilst a fairly high pumping force is achieved for its size, the micro-pump, overall occupying a volume of around 4 $cm^3$, is still too large for today's requirements.

In order to reduce the size of micro-pumps still further, whilst retaining sufficient driving force in the actuator to perform efficient, leak-free, reliable pumping, an improved actuator is required.

US2002/0037221A describes a wax micro-actuator for use in a micro-fluidic system. The micro-pump comprises a substrate having a heater member. The substrate and heater member form a first portion. A second portion is provided adjacent the first portion. The second portion includes a high actuating power polymer (HAPP) portion, at least one resin layer and a shield member. The second portion is selectively shaped to form a thermal expansion portion. A diaphragm member encapsulates the thermal expansion portion so that when power is applied to the heater portion, the HAPP portion expands against the diaphragm member causing it to deflect. As the temperature in the HAPP portion reaches its solid-liquid-transition-temperature, the specific volume of polymer increases. With further heat input from the heater layer, the HAPP portion undergoes a phase transition. During the phase transition, the specific volume increases dramatically causing deflection of the diaphragm member. The diaphragm member may be connected to, or may itself form part of a pumping chamber which increases and decreases in volume as the diaphragm deflects.

Various heating systems are known in the art for wax actuators but these predominately relate to relatively large actuator devices rather than micro-actuators. For example GB1204836 describes a wax actuator with an embedded heater filament. FR2731475 describes a wax actuator having a conductive heating element disposed external to the working cavity. This provides for inefficient heating of the wax.

The device of US2002/0037221A is essentially planar having a thin film, low power, heating element. This poses a number of problems. The heater element arrangement is such that the wax is heated inefficiently. Also, the volume of wax is limited as a result of poor heat distribution due to this arrangement.

There is therefore a need in the art for an improved micro-actuator having an expandable working medium, which is thermally efficient, thus enabling further size reductions, that is accurately controllable, and is scalable. These and other objects will become apparent from the following description of the invention.

SUMMARY OF THE INVENTION

According to the present invention there is provided an actuator comprising a cavity containing a working medium that reversibly expands as it undergoes a phase change from a solid to a liquid state, a diaphragm disposed adjacent the cavity such that expansion and contraction of the working medium causes the diaphragm to deflect, and a semiconductor element disposed in the cavity, wherein the semiconductor element is adapted to heat the working medium to cause it to undergo the phase change into the liquid state.

The present invention is advantageous in providing an actuator that is thermally efficient. This is achieved by use of an efficient semiconductor element disposed within the cavity that contains the expandable working medium. In this way, heat transfer from the semiconductor element when energised is transferred directly to the expandable working medium. In a preferred embodiment of the present invention the semiconductor element is positioned adjacent the diaphragm such that a portion of the working medium nearest the diaphragm is that which expands first upon energising the semiconductor element and contracts last upon de-energising the semiconductor element. This has been found to improve control of the actuator.

By positioning the semiconductor element such that it is immersed in the working medium and does not contact sides of the cavity a more uniform phase change between the solid and the liquid state of the working medium can be ensured. This arises as a result of both more uniform heating and substantially free flow of working medium, when in the liquid state, around the semiconductor element within the cavity.

Once the working medium has been heated from its solid state to its phase transition temperature, the amount of heat energy required to melt the working medium is approximately 100 fold greater than that that is required to heat the solid working medium by 1° C. If all of the working medium is allowed to become liquid then continuous application of a similar rate of heat transfer would cause dangerously high temperatures in a very short time. To prevent this thermal runaway it is therefore preferred that only some of the working medium in the cavity is intended to undergo the phase change during actuation.

The working medium is preferably a blend of paraffin waxes, a first wax that causes expansion and a second wax of a lower molecular weight than the first that fills between a crystalline structure of the first. The waxes are preferably both substantially pure so as to ensure as sharp a melting point as possible. This again helps to ensure accurate temperature control within the cavity.

The semiconductor element may be a semiconductor diode having electrical connections positioned adjacent the diaphragm. The working medium preferably fills the space between the diaphragm and the electrical connections so as to allow free flow of the liquid working medium around the electrical connections and the semiconductor diode.

The actuator may further comprise a gearing system to amplify either a linear or volume displacement of the diaphragm. The gearing system may include a gearing piston adapted to deflect a gearing diaphragm that is larger than the actuator diaphragm to thereby amplify the volume displaced by the actuator.

In a preferred embodiment of the present invention, the actuator is used to drive a pump for pumping liquid therapeutic product. The pump comprises a pumping chamber having an inlet and an outlet, wherein a volume of the pumping chamber is caused to change by actuation of the actuator. Such a pump is preferably a part of an infusion system having a reservoir of therapeutic product held at a positive pressure with respect to the ambient pressure. To prevent leakage of the positive pressure system, the pump preferably has inlet and outlet valves on opposing sides of the pumping chamber in the direction of fluid flow wherein the outlet valve has a higher activation pressure than the inlet valve.

According to a further aspect of the present invention, there is provided a pump for pumping liquid therapeutic product, comprising a pumping chamber having an inlet valve and an outlet valve, wherein a volume of the pumping chamber is caused to change by operation of a thermal expansion actuator, and wherein the outlet valve has a higher activation pressure than the inlet valve.

The actuator and pump of the present invention are preferably micro-components and the pumping chamber of the pump has a volume preferably less than approximately 100 μl.

BRIEF DESCRIPTION OF THE DRAWINGS

Examples of the present invention will now be described in detail with reference to the accompanying drawings, in which.

DETAILED DESCRIPTION

Figure 1:
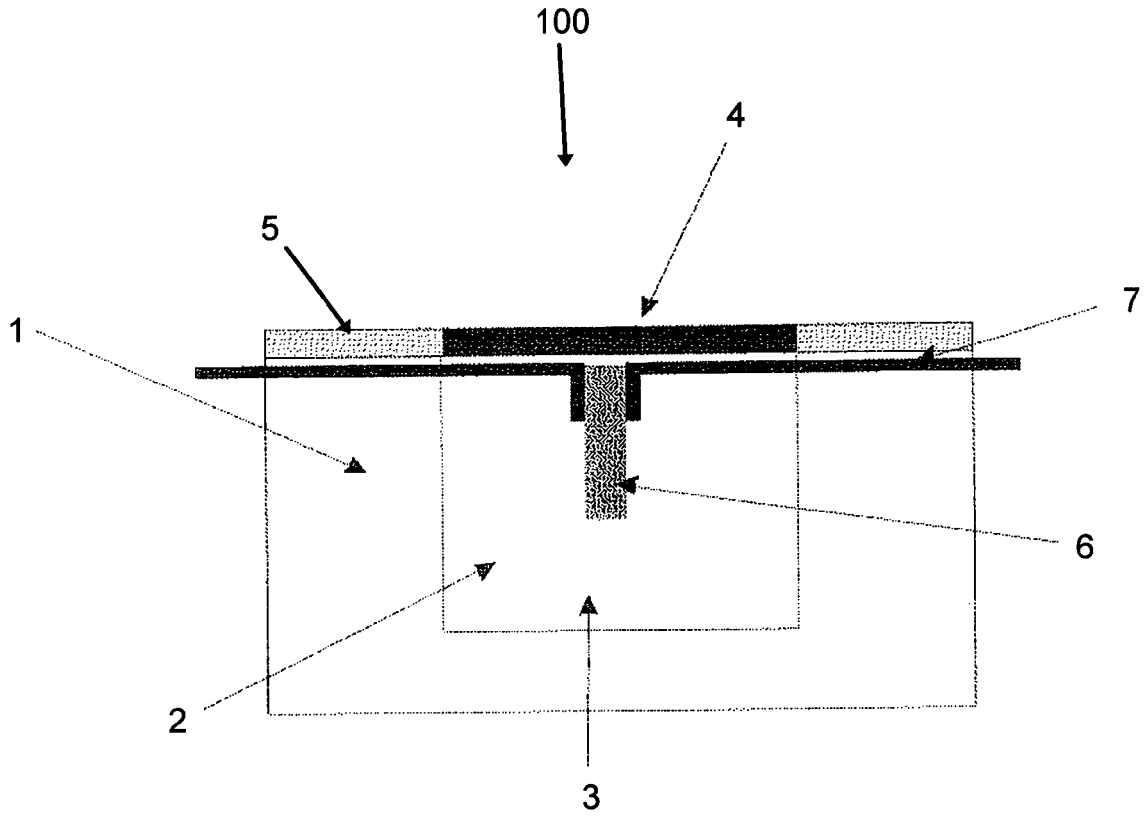
FIG. 1 is a cross-section view through an actuator in accordance with a first embodiment of the present invention.

Turning firstly to FIG. 1 there is shown the first embodiment of the actuator in accordance with the present invention.

The actuator comprises a body 1 defining in part a cavity 2 filled with a working medium 3 that reversibly expands as it undergoes a phase change from a solid to a liquid state. It therefore contracts upon undergoing the reverse phase transition from liquid to solid. Such phase transitions are repeatable indefinitely and may be caused by a change of temperature of the working medium. The cavity 2 is further bounded by a diaphragm 4 held captive by a frame 5 connected to the body 1. The diaphragm 4 is disposed such that expansion and contraction of the working medium 3 causes the diaphragm 4 to deflect. The working medium 3 is heated by a semiconductor element 6 disposed within the cavity 2. Electrical connections 7 connected to the semiconductor element 6 supply electric power to the semiconductor element 6.

The diaphragm 4 is of flexible, resilient elastomeric material, for example rubber, that deforms as the volume of the working medium 3 increases as it undergoes the phase change from solid to liquid. The frame 5 is of rigid plastics material, as is the body 1. The plastics and elastomeric materials can be moulded into their desired shapes easily and at low cost such that the actuator 100 may be manufactured in large volumes and is disposable. The plastics and elastomeric materials are also lightweight. Other materials for the frame, diaphragm and body may be used in the alternative, such as metal, ceramic, glass and silicon, as will be appreciated by those skilled in the art.

The actuator is manufactured by automated assembly such that the working medium 3, when solid, occupies the cavity 2 such that the diaphragm 4 is substantially planar. This ensures that when the frame 5 having the diaphragm 4 is connected to the body 1, the cavity 2 contains substantially no gas. The presence of gas in the cavity would cause a significant problem since the expansion of gas when heated is significantly greater than the expansion of the working medium 3 when it undergoes the phase transition from the solid to the liquid state. Also, since gas is compressible, expansion of the working medium 3 could cause compression of the gas rather than deflection of the diaphragm 4. Therefore, any gas in the cavity could cause uncontrollable deflection of the diaphragm 4 leading to unreliable actuator operation.

The semiconductor element 6 is a small semiconductor diode that generates heat when supplied with electrical energy. Positioning of the semiconductor element 6 within the cavity greatly affects the controllability and thermal efficiency of the actuator 100. As shown in FIG. 1, the semiconductor element 6 is preferably disposed adjacent the diaphragm 4, but not touching it. By positioning the semiconductor element 6 adjacent the diaphragm 4, any of the solid working medium 3 that becomes melted by the semiconductor element 6 has the opportunity to deflect the diaphragm 4. Otherwise, the molten working medium 3 may get trapped in an enclosed space resulting in a reduction in control of the diaphragm 4 for a given temperature of the semiconductor element 6. To ensure this is so, working medium 3 is also provided between the diaphragm 4 and the electrical connections 7 and semiconductor element 6.

Figure 2:
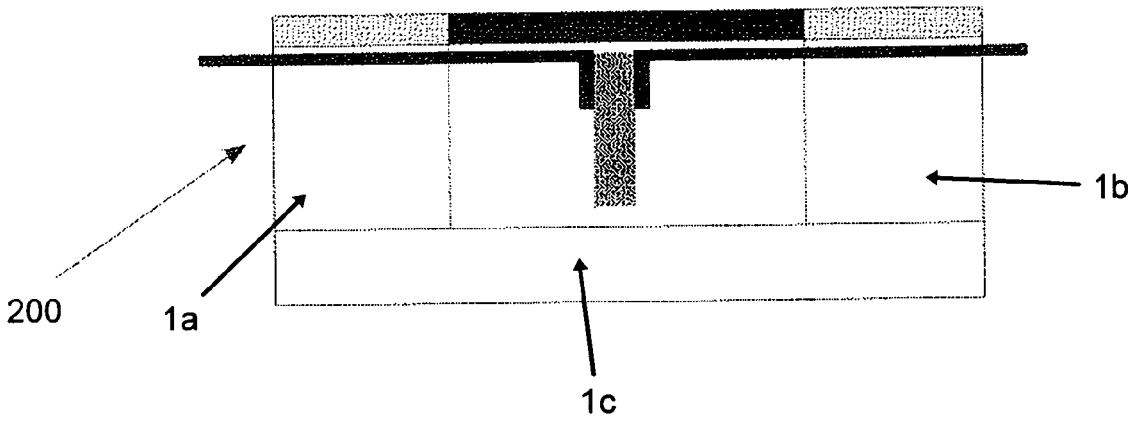
FIG. 2 is a cross-section view of an actuator in accordance with a second embodiment of the present invention.

The semiconductor element 6 is also orientated with respect to the cavity so as to maximise potential flow of molten working medium 3 around the semiconductor element 6. In fact, the orientation of the semiconductor element 6 shown in FIG. 1 has been found to present the best hydrodynamically efficient orientation and shape of the semiconductor element 6 possible. The semiconductor element 6 is disposed substantially centrally within the cavity 2, that is it is substantially equidistant from each of the side walls 1*a*, 1*b* of the body 1, as shown in FIG. 2. The cavity is preferably essentially rectangular in cross-section but circular, octagonal, hexagonal, square or similar cross-sections may be used instead. To increase the thermal efficiency of the actuator 100, by disposing the semiconductor element 6 from the side walls 1*a*, 1*b*, potential heat loss from the body 1 is reduced whilst maximising contact between the semiconductor element 6 and the working medium 3.

The volume of solid working medium 3 within the cavity 2 is greater than the volume of the working medium 3 which is intended to undergo the phase transition from the solid to the liquid state. The relative ratio of these volumes is arranged such that the molten working medium 3 does not contact the side walls 1*a*, 1*b*, or base 1*c*, of the body 1 when in use. This provides two advantages. Firstly, the part of the working medium 3 at the highest temperature, that which is nearest the semiconductor element 6 when energised, does not contact the body 1, which would lead to an increase in the thermal loss from the actuator 100. More importantly, however, this ensures that a rapid increase in the temperature of the working medium 3 within the cavity 2 does not occur since the work done is almost exclusively involved in the change of state of the medium. Once the working medium 3 has been heated from its solid state to its phase transition temperature, the amount of heat energy required to melt the working medium 3 is approximately 100 fold greater than that that is required to heat the working medium when in its liquid state by 1° C. If all of the working medium 3 is allowed to become liquid then continuous application of a similar rate of heat transfer from the semiconductor element 6 would cause dangerously high temperatures in very short times leading to thermal run-away. This is a particular problem where the actuator 100 is a micro-actuator of very small size and having a volume of working medium 3 in the order of less than approximately 100 μl. Temperatures of around 300° C. and higher are possible within milliseconds when thermal run-away occurs with such small volumes of working medium 3.

In the embodiment of FIG. 1, the side walls 1*a*, 1*b* and base wall 1*c* of the body 1 are integrally formed. Whilst this enables simple manufacture of the actuator using a small number of parts, such a construction can prove difficult in ensuring that the cavity 2 is filled with working medium 3 during the manufacturing process such that the cavity 2 contains substantially no gas. During manufacture, the frame 5 having the diaphragm 4 is connected to the body 1 after the cavity 2 has been filed with working medium 3 up to and above the level of the semiconductor element 6 and its electrical connections 7, such that an upper surface of the solid working medium 3 is flush with a top surface of the body side walls 1*a*, 1*b*. This may be achieved by filling the cavity 2 with an amount of the liquid working medium 3 of a predetermined volume such that upon contraction during phase transition to the solid state the top surface of the working medium 3 lies flush with the top surface of the body side walls 1*a*, 1*b*.

However, this is difficult to achieve in practice due to the surface tension of the liquid working medium 3 prior to solidification. Accordingly, it may be necessary to overfill the cavity 2 with working medium 3 and then, once the working medium 3 has solidified, level off the top surface of the working medium 3 to the level of the top surface of the body side walls 1*a*, 1*b*. This levelling may be performed using a scraper, or the like. However, the use of a scraper will rarely produce a precisely flat top surface to the working medium 3 and so when the frame 5 having the diaphragm 4 is connected to the body 1 gas may become trapped within the cavity 2.

To alleviate such problems, it may be necessary to form the body 1 from a plurality of constituent parts. Turning to FIG. 2 there is shown a second embodiment of the present invention, substantially identical to that of the first embodiment of the present invention shown in FIG. 1, but where the body 1 comprises two constituent parts, namely side walls 1*a*, 1*b*, and a base 1*c*. In manufacturing the actuator 200 in accordance with the second embodiment of the present invention, the frame 5 having the diaphragm 4 is connected to the side walls 1*a*, 1*b*, which may be integrally formed, prior to filling of the cavity 2 with working medium 3. A similar procedure may be performed for filling the cavity 2 with the working medium 3 as in accordance with the first embodiment of the present invention except that it is what is to become the lower surface of the working medium 3 that needs to be levelled prior to fixing of the base 1*c*. However, since the working medium 3 immediately adjacent the base 1*c* is not intended to melt during operation of the actuator, any gas that becomes trapped between the working medium 3 and the base 1*c* remains trapped between the solid base 1*c* and the solid working medium 3. Any gas within the cavity 2 therefore does not in any way disrupt operation of the actuator 200.

Figure 3:
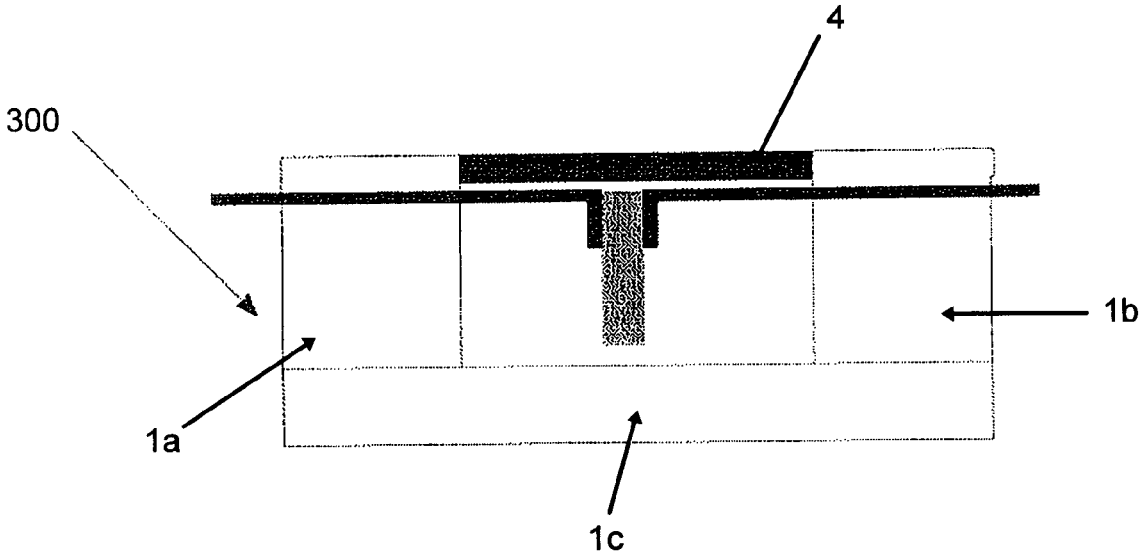
FIG. 3 is a cross-section view of an actuator in accordance with a third embodiment of the present invention.

FIG. 3 shows a third embodiment of the present invention substantially identical to the second embodiment of the present invention described with reference to FIG. 2, except that in the actuator 300 the diaphragm 4 is retained by the side walls 1*a*, 1*b*, thus negating the requirement for a frame 5. It will be appreciated by those skilled in the art that elements of the first, second and third embodiments of the present invention may be readily combined.

Figure 4A:
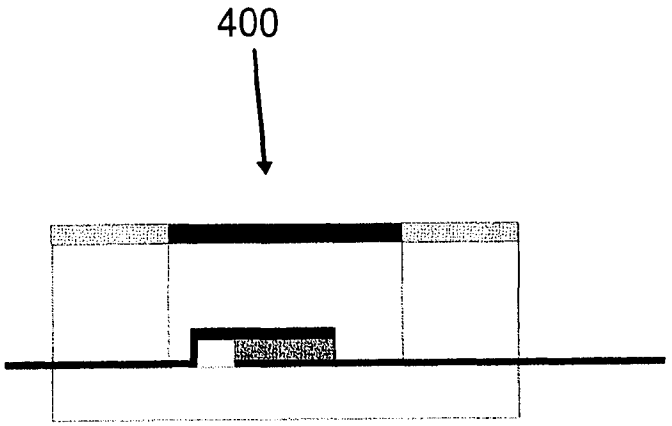
FIGS. 4*a*, 4*b*, 4*c* and 4*d* show cross-section views of an actuator in accordance with fourth to seventh embodiments of the present invention.
Figure 4B:
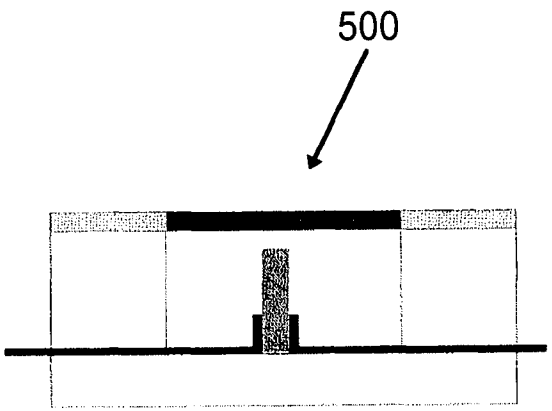
Figure 4C:
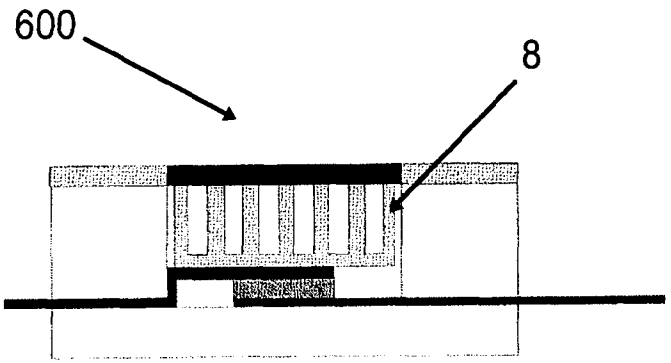
Figure 4D:
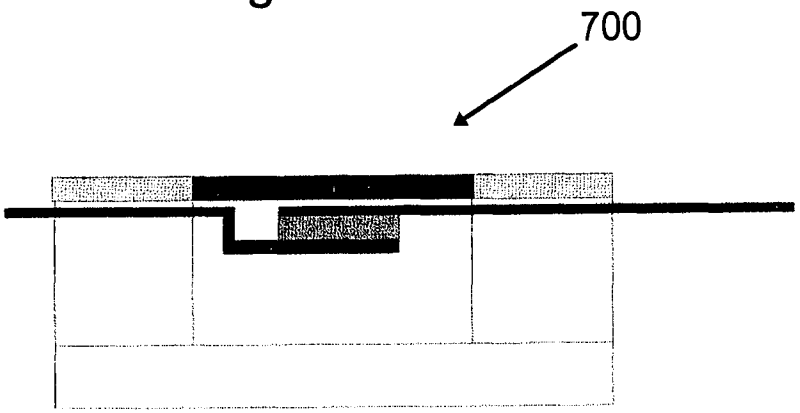

As discussed previously the positioning and orientation of the semiconductor element 6 within the cavity 2 is important in ensuring accurate control leading to good performance of the actuator. However, for various reasons of ease of manufacture, or size of the actuator, various other arrangements for the semiconductor element 6 within the cavity 2 are envisaged. FIGS. 4*a* to 4*d* illustrate examples of the fourth to seventh embodiments of the present invention, respectively. The actuator 400 shown in FIG. 4*a* has the semiconductor element 6 oriented parallel to and adjacent the base 1*c*. The actuator 500 has the semiconductor element 6 oriented perpendicular to and adjacent the base 1*c*. The actuator 600 is similar to the actuator 400 and further comprises a radiator element for dissipating heat from the semiconductor element 6 into a the cavity 2. The actuator 700 shown in FIG. 4*d* shows the semiconductor element oriented parallel to and adjacent the diaphragm 4. Again, it will be appreciated by those skilled in the art that various elements of the first to seventh embodiments of the present invention may be readily combined.

The working medium 3 is preferably a blend of two different paraffin waxes wherein one has a higher molecular weight than the other. The higher molecular weight wax causes expansion and the lower molecular weight wax fills between a crystalline structure of the higher molecular weight wax. Both waxes are preferably substantially pure so as to ensure a sharp a melting point as possible. It will be appreciated by those skilled in the art that other types of wax such as thermostat waxes and Polyethylene glycols could be used as the working medium 3 in the actuator of the present invention. An example of a preferred wax composition comprises approximately 60% hexatriacontane and approximately 40% paraffin wax.

Figure 5:
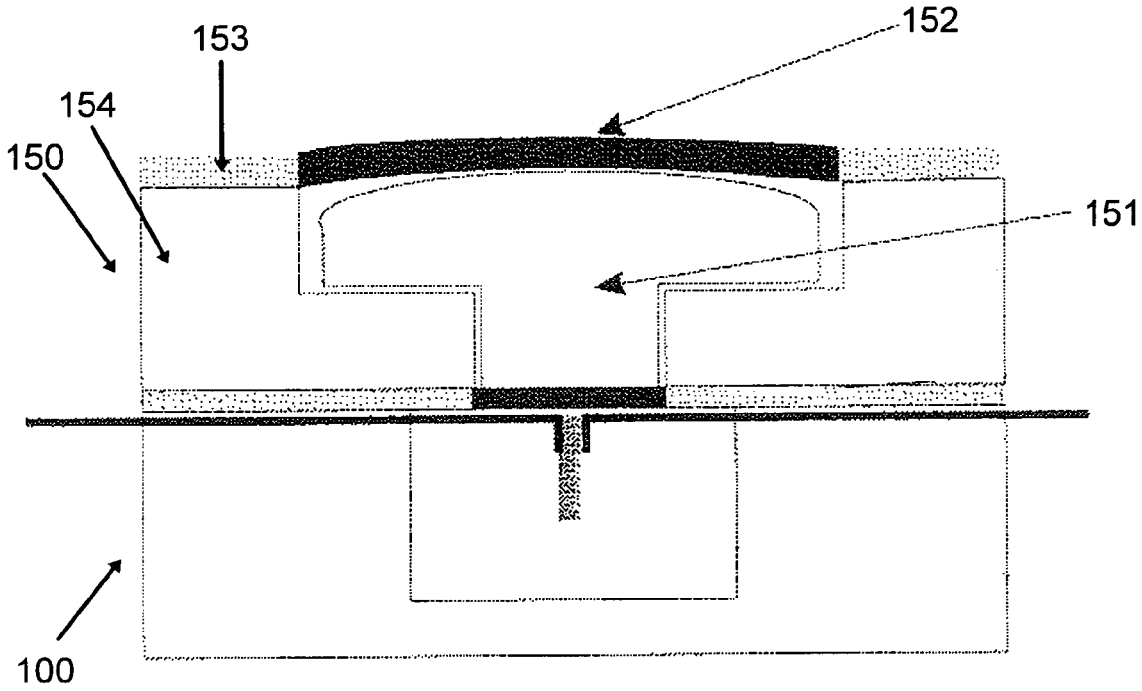
FIG. 5 shows a cross-section view of the actuator in accordance with the first embodiment of the present invention provided with a gearing system.

Whilst the displacement of the diaphragm 4 during operation of the actuator may be sufficient for some uses, it may be necessary to amplify the deflection of the diaphragm 4 by use of a gearing system. FIG. 5 illustrates the actuator 100 in combination with a gearing assembly 150. The function of the gearing system is to amplify either the linear displacement of the diaphragm 4, or increase the effective volume displacement resulting from the deflection of the diaphragm 4. A gearing assembly 150 shown in FIG. 5 is of a type for amplifying the volume displacement. The gearing assembly 150 comprises a gearing piston 151, and a gearing diaphragm 152 connected to a gearing frame 153. The gearing frame 153 is fixed to a body 154 of the gearing assembly 150.

The piston 151 is connected, or positioned in contact with, the actuator diaphragm 4. Movement of the piston 151 is restrained within the body 154 such that the piston 151 moves upwardly and downwardly with the diaphragm 4. The other end of the piston 151 is positioned just beneath the diaphragm 152 such that deflection of the actuator diaphragm 154 causes the piston 151 to move thus deflecting the gearing diaphragm 152. The gearing diaphragm 152 is larger than the actuator diaphragm 4 and due to the arrangement of the diaphragms 4, 152 and piston 151, the volume displacement of the gearing diaphragm 152 is significantly greater than the volume displacement of the actuator diaphragm 4. Whilst the force per unit area exerted by displacement of the gearing diaphragm 152 is less than the force per unit area exerted by deflection of the actuator diaphragm 4 due to the gearing assembly, this is not critical where the working medium 3 of the actuator is wax due to the high "energy density" of the wax actuator which enables the gearing diaphragm 152 to apply a sufficient force per unit area for many of the applications envisaged for the geared actuator.

The gearing assembly 150 has a small number of parts that are easy to manufacture and assemble and so the geared actuator may be produced at low cost and reliably to achieve a disposable product that provides good performance. The piston 151, frame 153 and body 154 are preferably of plastics material and the diaphragm 152 is preferably of flexible, resilient elastomeric material, for example rubber. Other materials for the piston, frame, body and diaphragm may be used in the alternative, such as metal, ceramic, glass and silicon as will be appreciated by those skilled in the art. The frame 153 could be integrally formed with the diaphragm 152.

It has been found that, particularly where the gearing assembly 150 is used, a return force may be required to assist in returning the actuator to its initial position, i.e. that as before melting of the working medium 3. The return force may be provided by a spring or other suitable known means to bias the gearing piston 151 towards the actuator 100. Preferably, the return force is provided by tension in the gearing diaphragm 152 and/or the actuator diaphragm 4. Where this is found to be insufficient, a tension spring connected at one end to the body 154 and at its other end to a flange of the piston 151 may be provided, for example. In the case that the actuator 100 is provided without the gearing assembly 150, it may be preferable to provide means for biasing the actuator diaphragm 4 towards the cavity 2 for the same reason. The absence of such a return force acting on the diaphragm 4 directly, or indirectly, may result in non-uniform cooling of the working medium 3 following heating. This will then have a knock-on effect during any subsequent heating operation leading to unreliable operation.

The gearing assembly 150 is particularly suitable for use in a geared micro-actuator assembly due to the relatively low profile of the gearing assembly 150. Whilst the gearing assembly 150 is of a volume amplifier type, it will be appreciated by those skilled in the art that a linear displacement amplifier type gearing assembly may be constructed using a system of levers, or gears and pulleys.

It is envisaged that the actuator, or the geared actuator, of the present invention has many possible uses, such as in valves and pumps for medical, industrial or environmental applications, and in a range of sizes from small/medium scale devices to micro-systems.

Figure 6:
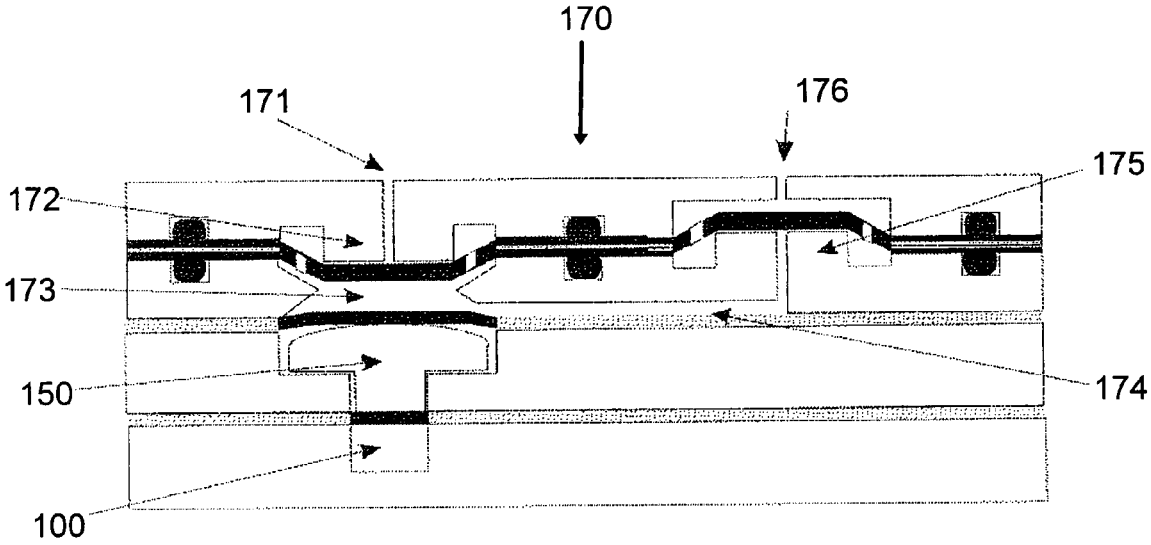
FIG. 6 shows a cross-section view through a pump comprising the actuator having the gearing system in accordance with FIG. 5; and, FIG. 7 illustrates the pump of FIG. 6 as part of an infusion system.

An example of an application of the geared micro-actuator of FIG. 5 is as a micro-pump, as shown in FIG. 6. The micro-pump 170 has a fluid inlet 171 leading to an inlet valve 172. Operation of the actuator 100 having the gearing assembly 150 causes a change in volume of a pumping chamber 173. Upon increasing the volume of the pumping chamber 173 by operation of the geared actuator 100, 150 the inlet valve 172 opens and fluid flows from the inlet 171 through the inlet valve 172 to fill the pumping chamber 173. Once the pumping chamber 173 is full, operation of the geared actuator 100, 150 to reduce the volume of the pumping chamber 173 forces the fluid along conduit 174 to outlet valve 175. Since the fluid passing through the conduit 174 is under pressure from the geared actuator 100, 150, the outlet valve 175 opens and fluid exits the pump via outlet 176.

The inlet and outlet valves 172, 175 are one-way valves such that upon a decrease in the volume of the pumping chamber 173 fluid therein does not pass through the inlet valve 172 to the inlet 171 and only passes along the conduit 174. Also, the outlet valve 175 closes when the pressure of the fluid in the conduit 174 decreases below a predetermined value. Repeated operation of the geared actuator 100, 150 causes fluid to be pumped from the inlet 171 to the outlet 176.

Figure 7:
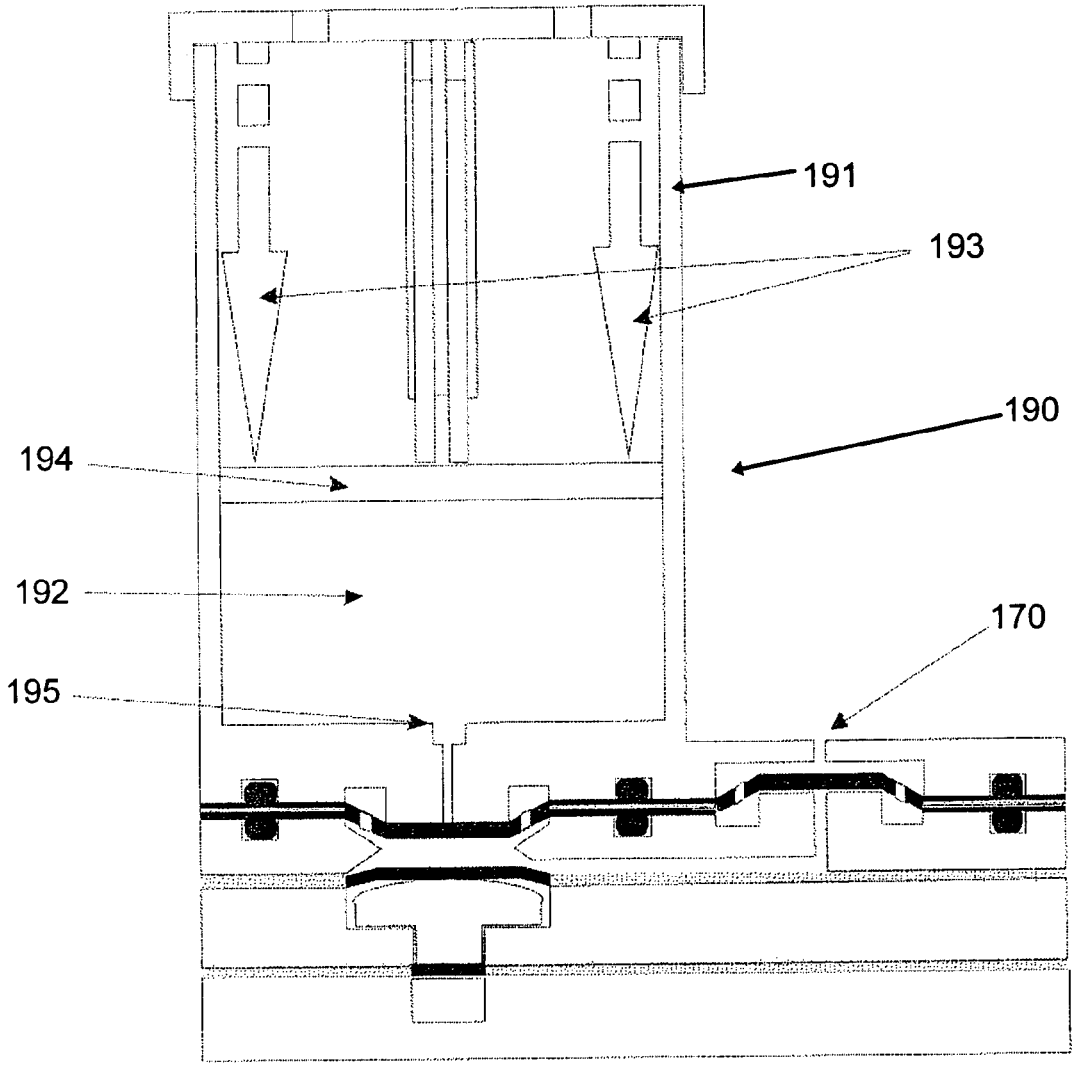

The micro-pump 170 described with reference to FIG. 6 finds particular use in a micro-infusion system for the delivery of therapeutic products into a human or animal body. The infusion system is shown in FIG. 7 and includes a pressurized reservoir 191 of therapeutic product 192. The therapeutic product 192 is pressurized within the reservoir by application of a force, indicated by 193, on a plunger 194 movable within the reservoir cavity. An outlet 195 of the reservoir is connected to the inlet 171 of the micro pump 170. Means for fluidically coupling the micro-pump 170 to a human or animal body to which the therapeutic product is to be delivered is connected at one end to the patient, and at the other end to the outlet 176 of the micro pump 170. This means may be a cannular or other similar device.

The actuator is preferably controlled by an electronics module (not shown) that works in co-operation with at least one flow rate indicator to ensure programmed delivery of the therapeutic product with a high degree of accuracy.

Various modifications of the present invention are envisaged as will be appreciated by the skilled person without departing from the scope of the invention, which is defined by the appending claims.

The invention claimed is:

1. An actuator comprising:

a cavity containing a working medium that reversibly expands as it undergoes a phase change from a solid to a liquid state;

a diaphragm disposed adjacent the cavity such that expansion and contraction of the expandable working medium causes the diaphragm to deflect; and a semiconductor element disposed in the cavity, wherein the semiconductor element is immersed in the working medium adjacent to the diaphragm and is adapted to heat the working medium to cause it to undergo the phase change into the liquid state.

2. An actuator according to claim 1, wherein the cavity comprises side walls and the semiconductor element is positioned substantially equidistant from each of the side walls of the cavity.

3. An actuator according to claim 1, wherein the semiconductor element is positioned within the cavity to permit substantially free flow of liquid working medium around the semiconductor element.

4. An actuator according to claim 1, wherein the cavity contains substantially no gas.

5. An actuator according to claim 1, wherein only some of the working medium in the cavity is intended to undergo the phase change during actuation.

6. An actuator according to claim 1, wherein the semiconductor element is a semiconductor diode.

7. An actuator according to claim 1, wherein the diaphragm is substantially planar when the working medium is in its solid state.

8. An actuator according to claim 1, wherein the diaphragm is biased and/or is resilient such that it returns to a position as before melting of the working medium.

9. An actuator according to claim 1, further comprising a gearing system to amplify either a linear or volume displacement of the diaphragm.

10. An actuator according to claim 9, wherein the gearing system includes a gearing piston adapted to deflect a gearing diaphragm, larger than the actuator diaphragm.

11. An actuator according to claim 1, wherein electrical connections to the semiconductor element are disposed at least partially within the cavity.

12. An actuator according to claim 11, wherein the electrical connections are positioned adjacent the diaphragm.

13. An actuator according to claim 12, wherein the working medium fills a space between the diaphragm and the electrical connections.

14. An actuator according to claim 1, wherein the working medium includes wax.

15. An actuator according to claim 14, wherein the wax is substantially pure.

16. An actuator according to claim 14, wherein the wax includes a blend of different two waxes, one having a higher molecular weight than the other.

17. An actuator according to claim 16, wherein the working medium comprises approximately 60% hexatriacontane and approximately 40% paraffin wax.

18. An actuator according to claim 1, wherein the cavity is bounded by an actuator body and the diaphragm.

19. An actuator according to claim 18, wherein the body is unitary.

20. An actuator according to claim 18, wherein the body has a removable end remote from the diaphragm to permit filling and/or draining of the cavity with the working medium.

21. An actuator according to claim 18, wherein the diaphragm is connected to a frame member attached to the body.

22. An actuator according to claim 18, wherein the diaphragm is attached directly to the body.

23. A pump for pumping liquid therapeutic product, comprising:

an actuator, the actuator including:

a cavity containing a working medium that reversibly expands as it undergoes a phase change from a solid to a liquid state;

a diaphragm disposed adjacent the cavity such that expansion and contraction of the expandable working medium causes the diaphragm to deflect;

a semiconductor element disposed in the cavity, wherein the semiconductor element is immersed in the working medium adjacent to the diaphragm and is adapted to heat the working medium to cause it to undergo the phase change into the liquid state; and a pumping chamber having an inlet and an outlet, wherein a volume of the pumping chamber is caused to change by actuation of the actuator.

24. A pump according to claim 23, wherein the pumping chamber volume is less than approximately 100 μl.

25. A pump according to claim 23, further comprising an inlet valve.

26. A pump according to claim 25, further comprising an outlet valve.

27. A pump according to claim 26, wherein the outlet valve has a higher activation pressure than the inlet valve.

28. An infusion system comprising:

a pump, the pump including a pumping chamber having an inlet and an outlet, wherein a volume of the pumping chamber is caused to change by actuation of the actuator; and an actuator, the actuator including:

a cavity containing a working medium that reversibly expands as it undergoes a phase change from a solid to a liquid state;

a diaphragm disposed adjacent the cavity such that expansion and contraction of the expandable working medium causes the diaphragm to deflect;

a semiconductor element disposed in the cavity, wherein the semiconductor element is immersed in the working medium adjacent to the diaphragm and is adapted to heat the working medium to cause it to undergo the phase change into the liquid state.

* * * * *